US005877138A

United States Patent [19]

Ditze et al.

[11] Patent Number: 5,877,138

[45] Date of Patent: Mar. 2, 1999

[54] CARPET CLEANING FORMULATION

[75] Inventors: Alexander Ditze, Remscheid; Bernd-Dieter Holdt, Duesseldorf; Thomas Hahn, Hueckelhoven; Franz Kresse; Theo Fleckenstein, both of Hilden, all of Germany

[73] Assignee: Henkel Kommanditgesellschaft auf Aktien, Duesseldorf, Germany

[21] Appl. No.: 718,560

[22] PCT Filed: Mar. 21, 1995

[86] PCT No.: PCT/EP95/01043

§ 371 Date: Oct. 11, 1996

§ 102(e) Date: Oct. 11, 1996

[87] PCT Pub. No.: WO95/27024

PCT Pub. Date: Oct. 12, 1995

[30] Foreign Application Priority Data

Mar. 30, 1994 [DE] Germany ..... P 44 11 046.4

[51] Int. Cl.[6] ..... C11D 17/04; D06L 17/04

[52] U.S. Cl. ..... 510/280; 510/291

[58] Field of Search ..... 510/280, 291

[56] References Cited

U.S. PATENT DOCUMENTS

| | | | |
|---|---|---|---|
| 3,598,844 | 8/1971 | Ruckert et al. | 260/349 |
| 4,581,385 | 4/1986 | Smith et al. | 521/111 |
| 4,659,494 | 4/1987 | Soldanski etal. | 252/88 |
| 4,801,621 | 1/1989 | Reischl | 521/53 |
| 4,834,900 | 5/1989 | Soldanski et al. | 252/88 |

FOREIGN PATENT DOCUMENTS

| | | |
|---|---|---|
| 296 477 | 2/1972 | Austria . |
| 178 566 | 4/1986 | European Pat. Off. . |
| 2 015 972 | 4/1970 | France . |
| 2 240 287 | 3/1975 | France . |
| 5 043 900 | 2/1993 | Japan . |

*Primary Examiner*—Mukund J. Shah
*Assistant Examiner*—Tamthom T. Ngo
*Attorney, Agent, or Firm*—Ernest G. Szoke; Wayne C. Jaeschke; Steven J. Trzaska

[57] ABSTRACT

A scatterable dry cleaning composition containing: (a) cellulose powder adsorbent; (b) ground polyurethane foam absorbent; and (c) water.

9 Claims, No Drawings

CARPET CLEANING FORMULATION

BACKGROUND OF THE INVENTION

This is a 371 application of PCT/EP95/01043 filed Mar. 21, 1995, which claims the priority of DE P4411046.4 filed Mar. 30, 1994.

1. Field of the Invention

This invention relates to a scatterable formulation for the dry cleaning of textiles, more especially carpets.

2. Discussion of Related Art

In addition to shampoos, powder-form cleaning formulations have recently been increasingly used for cleaning carpets and other textile coverings in situ, enjoying the advantage that they do not leave any marks and dry more quickly. Cleaning powders of the type in question consist essentially of relatively large quantities of adsorbents and a cleaning liquid—generally consisting for the most part of water—adsorbed thereon. It is assumed that the cleaning liquid is responsible for separating the soil particles from the fibers and transporting them to the adsorbent which, after drying, is removed together with the soil either by brushing or by vacuum cleaning. Various materials have been proposed as adsorbents. Of these, it is only intended here to mention the foam plastic powders described in Austrian patent 296 477. Above all, ground foam of urea/formaldehyde resin has been widely used in practice. More recent developments, as described for example in European patent application 178 566, have led to the use of cellulose powder as an adsorbent. Although an extremely high standard in regard to cleaning performance and non-discoloration had been achieved with cleaning formulations based on cellulose powder, a search was nevertheless made for new compositions which would have an even higher cleaning performance with less dust emission and which could be worked into the carpet without difficulty.

DESCRIPTION OF THE INVENTION

The present invention represents a solution to this problem in the form of a scatterable dry cleaning formulation for textiles which contains cellulose powder as adsorbent and also water and which is characterized in that it contains ground polyurethane foam as an additional adsorbent. In addition, the formulations according to the invention preferably contain relatively small quantities of lower alcohols, viscose sponge flakes and/or surfactants.

The formulations according to the invention are distinguished by an improved cleaning performance with less dust emission and by less wear and tear on the carpet fibers in the working-in phase by comparison with formulations containing cellulose powder as sole adsorbent.

The cellulose powders suitable for use in accordance with the invention are produced from commercial cellulose, which is generally obtained from parts of plants, more especially from wood, by size reduction using mechanical and/or chemical processes. Corresponding powders, which are colorless and substantially free from lignin and other impurities emanating from the plant material, are commercially available in various degrees of fineness. The finer qualities with an average fiber length of 50 to 400 μm are preferred for the purposes of the present invention. In these qualities, the average fiber thickness is between 10 and 50 μm. The particle size of the cellulose powder may also be determined by screening techniques, for example by air jet screening in accordance with DIN 53734. Accordingly, cellulose powders with the following particle size distribution (as determined by the above-mentioned method) are also preferred:

under 32 μm: 40±10% by weight
under 50 μm: 55±10% by weight
under 71 μm: 75±10% by weight
under 100 μm: 85±10% by weight
under 200 μm: at least 99% by weight.

Cellulose powders produced from wood cellulose, more particularly from hardwood cellulose, are preferably used in the formulations according to the invention. Of these powders, those qualities which can readily be obtained solely by mechanical methods, for example by grinding, are particularly preferred. The percentage content of cellulose powder in the formulation according to the invention is preferably from 20 to 60% by weight and more preferably from 25 to 50% by weight, based on the final formulation.

In addition to the cellulose powder, the formulations according to the invention contain ground polyurethane foam, also known as polyurethane foam flour or—in short—as polyurethane flour, as an additional adsorbent. Polyurethane flour is normally obtained by grinding rigid polyurethane foam, a widely used material which is normally employed for heat insulation. Corresponding polyurethane flours are also commercially available. Polyurethane flours with apparent densities of 35 to 200 g/l and preferably 50 to 100 g/l are preferably used for the purposes of the invention. Other preferred polyurethane flours are those of which the screen analysis, as determined by the above-mentioned air-jet method, shows the following distribution:

under 40 μm: 10±5% by weight
under 125 μm: 25±10% by weight
under 200 μm: 40±10% by weight
under 4 mm: at least 99% by weight.

The percentage content of polyurethane flour corresponding to this specification in the formulations according to the invention is preferably from 5 to 20% by weight and more preferably from 5 to 15% by weight.

In addition to cellulose powder and ground polyurethane foam, the formulations according to the invention may contain relatively small quantities of other adsorbents which are known per se for use in dry cleaning formulations, for example starch flour, bentonite or ground foam glass (perlite), providing they do not adversely affect the properties of the formulations. Another adsorbent which may be present with particular advantage in the formulations are flakes of viscose sponge, preferably with a maximum particle length of 1 to 10 mm and a maximum dimension perpendicularly of their length (optionally particle diameter) of 1 to 5 mm.

The use of viscose sponge flakes on the one hand reduces the wear and tear of the carpet fibers during the removal and incorporation of the cleaning formulation in the carpet and, on the other hand, distinctly increases the cleaning effect of the formulation. Viscose sponge flakes are generally obtained by mechanical size reduction of relatively large pieces of viscose sponge, preferably by cutting up viscose sponge cloths, and are commercially available in various sizes. The viscose sponge flakes are added to the formulations according to the invention generally in quantities not exceeding 15% by weight and preferably in quantities of 0.1 to 10% by weight, based on the final formulation.

In the most simple case, the formulations according to the invention contain water as sole impregnating liquid in addition to the adsorbents mentioned above. The quantity in which this liquid is used is gauged in such a way that it is still taken up by the solid constituents of the formulation, i.e. in particular by the cellulose powder, thus guaranteeing the scatterability of the formulation. The water content consisting of the water added during production and the water already present in the raw materials is preferably from 35 to 70% by weight and more preferably from 40 to 60% by weight.

However, if appropriate for special reasons, the impregnating liquid may contain other auxiliaries and additives which are advantageous, for example, for increasing the cleaning effect or for preserving the final formulation. For example, the liquid may contain organic solvents. Suitable organic solvents are both water-miscible and water-immiscible solvents providing they do not attack the textiles and are sufficiently volatile to evaporate in the required time after application of the formulation to the textile. In addition, it is important when selecting the solvent to bear in mind that it should have a sufficiently high flashpoint in the final product mixture and should be toxicologically safe. Suitable solvents are alcohols, ketones, glycol ethers and hydrocarbons, for example isopropanol, acetone, ethers of monoethylene and diethylene glycol and mono-, di- and tripropylene glycol with boiling points between 120° C. and . . . and gasolines with boiling points of 130° to 200° C. and also mixtures of these solvents. Alcohols containing 2 to 3 carbon atoms and mixtures thereof are preferably used. The percentage content of organic solvent is normally not more than 20% by weight and, more particularly, is from 2 to 10% by weight, based on the cleaning formulation as a whole.

In addition, the formulations according to the invention may contain surfactants as cleaning-active additives, the surfactants emanating from the classes of anionic and nonionic surfactants. Although excellent surface cleaning is achieved without the addition of a surfactant, the removal of greasy stains can be further improved by the addition of surfactants. In general, a surfactant addition of up to 5% by weight is sufficient. The formulations preferably contain 0.05 to 3% by weight and, more preferably, 0.05 to 1% by weight, based on the total weight of the formulation, of surfactants. Of the large number of known surfactants, those substances which, together with the adsorbents and other non-volatile constituents, if any, present in the formulations, dry off to leave a solid brittle residue are particularly suitable.

Suitable nonionic surfactants for the formulations according to the invention are, in particular, adducts of 1 to 30 moles and preferably 4 to 15 moles of ethylene oxide or mixtures of ethylene oxide and propylene oxide with 1 mole of a compound containing 10 to 20 carbon atoms from the group of alcohols, alkylphenols, carboxylic acids and carboxylic acid amides. The condensation products of reducing sugars and long-chain alcohols known as alkyl glycosides are also eminently suitable. The adducts of ethylene oxide with long-chain primary or secondary alcohols, for example fatty alcohols or oxoalcohols, and the alkyl polyglucosides containing 1 to 3 glucose units per molecule and 8 to 18 carbon atoms in the alkyl group synthesized from glucose and fatty alcohols are particularly preferred.

Suitable anionic surfactants are, in particular, those of the sulfate or sulfonate type, although other types, such as soaps, long-chain N-acyl sarcosinates, salts of long-chain sulfosuccinic acid esters or salts of ether carboxylic acids obtainable from long-chain alkyl or alkylphenyl polyglycol ethers and chloroacetic acid, may also be used. The anionic surfactants are preferably used in the form of the sodium salts, although the lithium salts may also afford advantages.

Particularly suitable surfactants of the sulfate type are the sulfuric acid monoesters of long-chain primary alcohols of natural and synthetic origin containing 10 to 20 carbon atoms, i.e. fatty alcohols such as, for example, cocofatty alcohols, tallow fatty alcohols, oleyl alcohol or the $C_{10-20}$ oxoalcohols, and sulfuric acid monoesters of secondary alcohols with the same chain lengths. In addition, sulfuric acid monoesters of aliphatic primary alcohols, secondary alcohols or alkylphenols ethoxylated with 1 to 6 moles of ethylene oxide are also suitable, as are sulfated fatty acid alkanolamides and sulfated fatty acid monoglycerides.

The surfactants of the sulfonate type are, primarily, sulfosuccinic acid monoesters and diesters containing 6 to 22 carbon atoms in the alcohol components, alkyl benzene sulfonates containing $C_{9-15}$ alkyl groups and esters of α-sulfofatty acids, for example the α-sulfonated methyl or ethyl esters of hydrogenated coconut oil, palm kernel oil or tallow fatty acids. Other suitable surfactants of the sulfonate type are the alkane sulfonates obtainable from $C_{12-18}$ alkanes by sulfochlorination or sulfoxidation and subsequent hydrolysis or neutralization or by bisulfite addition onto olefins and the olefin sulfonates, i.e. mixtures of alkene and hydroxyalkane sulfonates and also disulfonates obtained, for example, from long-chain monoolefins with a terminal or internal double bond by sulfonation with gaseous sulfur trioxide and subsequent alkaline or acidic hydrolysis of the sulfonation products.

Particularly preferred surfactants are the olefin sulfonates which are preferably used in quantities of 0.1 to 1% by weight in the formulations and the fatty alcohol sulfates and fatty alcohol ether sulfates which are preferably used in quantities of 0.05 to 3% by weight.

In addition to the components already mentioned, the formulations according to the present invention may also contain small quantities of other auxiliaries and additives typically encountered in textile and carpet cleaning compositions. Examples of such auxiliaries and additives are antistatic components, optical brighteners, redeposition inhibitors, additives which improve scatterability and dispersibility, preservatives and perfume. Above all in cases where dust-emitting components are to be incorporated in the formulations, it is advisable to add small quantities of waxes or oils to bind any dust. These auxiliaries and additives are normally used in total quantities of not more than 5% by weight and preferably in quantities of not more than 2% by weight, based on the formulation as a whole.

The production of the formulations does not involve any problems so that simple, generally single-stage processes may be applied. The production process is normally carried out using simple mixers, such as blade or drum mixers, in which the polyurethane flour and cellulose powder and any other fine-particle solid components are initially introduced and then sprayed in motion with the liquids in which other components may optionally be dissolved. Depending upon the mechanics and composition involved, the formulations can thus be produced in a very fine-particle form or even in more or less agglomerated form, although the composition always ensures that even the agglomerated forms readily disintegrate on the textiles without any need for significant mechanical work. Through the choice of flake-like agglomerates, the flow properties of the formulation can be reduced to the extent of extremely slow-flowing products which are preferred for certain applications.

The apparent density of the formulations may also be influenced to a certain extent in the production process by the choice of more or less compact agglomerates. Thus, the formulations normally have apparent densities of 200 to 350 g/l, with the result that comparatively large volumes are applied per unit area. This provides in particular for uniform distribution, particularly when the formulations are scattered onto carpets by hand.

The textiles and carpets are cleaned by scattering the cleaning formulation according to the invention onto the textiles either by hand or by means of a suitable distributor and then rubbing the formulation more or less intensively into the textiles, for example by means of a sponge or a brush. In general, the working-in times are between 0.5 and 2.5 minutes and preferably between 0.5 and 1.5 minutes per square meter. After the formulation has been rubbed in, the textiles are left to dry off until the cleaning formulation, which combines with the soil, has changed into dry residues. These residues are then removed from the textiles mechanically, for example by brushing or vacuum cleaning. For the surface cleaning of textiles, the formulation according to the invention is applied in quantities of 20 to 200 $g/m^2$, depending on the fullness of the textiles and the degree of soiling, although larger quantities may also be locally applied to remove individual stains. For cleaning carpets, the formulation is normally applied in quantities of 50 to 150 $g/m^2$. The process as a whole may largely be carried out manually, for example in the home, although it is also possible to carry out the rubbing in of the formulation and, optionally, other steps by means of suitable machines, for example combined distributing and brushing machines, so that the process is equally suitable for use in the institutional sector.

EXAMPLES

The cleaning formulations described in the following Examples were produced as follows:

Cellulose powder, polyurethane flour and, optionally, viscose flakes were introduced into and premixed in a blade mixer. The water-based cleaning liquid was separately prepared from the other components in a mixing vessel. The liquid was then sprayed onto the absorbent in motion in the blade mixer. Slightly moist but free-flowing products were formed in every case.

Arbocel® B 800 X, a product of J. Rettenmaier & Söhne, was used as the cellulose powder in the following Examples. According to the manufacturer, this cellulose powder has an average fiber length of 200 μm for an average fiber thickness of 20 μm and the following particle size distribution (as determined by air jet screening):

under 32 μm: 40% by weight
under 71 μm: 75% by weight
under 200 μm: 99.5% by weight.

A ground polyurethane foam powder marketed by the PUREN company under the name of Puren-PU-MehI was used as the polyurethane flour in the following Examples. The material has an apparent density of 55 to 70 g/l and the following particle size distribution (air jet screening):

under 40 μm: 9% by weight
under 125 μm: 26% by weight
under 200 μm: 31% by weight
under 4 mm: 99.8% by weight.

The viscose flakes used are a product of Beli-Chemie GmbH and are marketed for use as absorbing flakes for taking up spilt liquids. The material has an apparent density of around 90 g/l.

Cleaning performance was tested on pieces of carpeting which had been artificially soiled. The carpet material used was a light grey polyamide shag-pile carpet which had been cut into pieces measuring 122.5×79 cm and which was placed in a laboratory soiling drum containing 1500 g of steel balls and soiled for 30 minutes with 15 g of a test soil from the Wäschereiforschungsanstalt Krefeld (of which 85% by weight consisted of the sieved contents of a vacuum cleaner bag and 15% by weight of a standard mixture of kaolin, silica flour, iron oxide and soot). For the further tests, the piece of carpet was cut up into three equal pieces approximately 40 cm wide.

The cleaning tests were carried out on areas of around 0.5 $m^2$ of the soiled pieces of carpet by uniformly scattering 25 g of cleaning powder onto the surface and then working it in by brushing. The brush used was a medium-hard brush with polypropylene bristles with which the surface was uniformly brushed for about 25 seconds with vigorous strokes from various directions. After drying, which took about 4 hours, the pieces of carpet were thoroughly vacuum-cleaned until no visible powder residues remained on the carpet. The results obtained were evaluated using a Dr. Lange Micro Color color difference measuring instrument on the basis of the CIELAB method (DIN 6074). The three-dimensional color representation in the form of the L*, a* and b* diagram is used, the lightness (L*)—also known as the grey value—being situated on the vertical axis of the three-dimensional color body. The value $L^*_0=0$ is equated with black; the value $L^*_{100}=100$ is the lightness of the white standard where the untreated carpet was placed in the measurements carried out here.

Example 1

| Composition | | |
|---|---|---|
| 1.725 kg | cellulose powder | (34.4% by weight) |
| 0.50 kg | polyurethane flour | (10.0% by weight) |
| 0.35 kg | ethanol, 96% | (7.0% by weight) |
| 7.5 g | perfume | (0.15% by weight |
| 0.65 g | preservative | (0.013% by weight) |
| 2.46 kg | water | (to 100% by weight) |

The moist, readily scatterable powder had an apparent density of 200 g/l. It was compared in its cleaning performance with a similar formulation containing another 10% by weight of cellulose powder instead of polyurethane flour by the method described above. Where the cleaning formulation according to the invention was used, the lightness value obtained was 2 units higher than the value obtained with the comparison product.

Example 2

| Composition: | | |
|---|---|---|
| 1.50 kg | cellulose powder | (30.0% by weight) |
| 0.40 kg | polyurethane flour | (8.0% by weight) |
| 0.35 kg | ethanol | (7.0% by weight) |
| 25 g | absorbing viscose flakes | (0.5% by weight |
| 7.5 g | perfume | (0.15% by weight) |
| 0.65 g | preservative | (0.013% by weight) |
| 2.72 kg | water | (to 100% by weight) |

The apparent density of this equally free-flowing product was 225 g/l. Testing of cleaning performance by the method described above revealed a lightness value higher by 4 units than the value obtained with the comparison product of Example 1. In addition, it could clearly be seen that the wear and tear of the carpet fibers during working in of the formulation was reduced by the rolling effect of the viscose flakes.

Example 3

This formulation differed in its composition from the formulation of Example 2 solely in the additional presence of 0.1% by weight of sodium cocofatty alcohol sulfate (Texapon® K 12) in the impregnating liquid. The cleaning performance was 3.5 units higher than that of the comparison product of Example 1. In this case, too, it could clearly be seen that the brush slid easily over the carpet so that the carpet fibers were protected against wear and tear.

Example 4

This formulation differed in its composition from the formulation of Example 2 in the additional presence of 0.05% by weight of a nonionic surfactant (Dehydol® LS 4, $C_{12-14}$ fatty alcohol·4 EO) which was added through the impregnating liquid. The cleaning performance of the formulation was 4 units higher than that of the comparison product mentioned in Example 1. The same sliding effect as in Examples 2 and 3 was observed.

We claim:

1. A scatterable dry cleaning composition comprising:

(a) cellulose powder adsorbent;

(b) from 5% to 20% by weight, based on the weight of the composition of a ground polyurethane foam adsorbent; and (c) water.

2. The composition of claim 1 wherein the cellulose powder has an average fiber length of from 50 to 400 μm and an average fiber thickness of from 10 to 50 μm.

3. The composition of claim 1 wherein the ground polyurethane foam absorbent has a particle size distribution such that 10±5% by weight of the particles are under 40 μm, 25±10% by weight of the particles are under 125 μm, 40±10% by weight of the particles are under 200 μm, and at least 99% by weight of the particles are under 4 mm, all weights being based on the total particle size distribution of the ground polyurethane foam absorbent.

4. The composition of claim 1 further containing up to 15% by weight of viscose sponge flakes, wherein the viscose sponge flakes have a maximum particle length of from 1 to 10 mm and a maximum diameter of from 1 to 5 mm.

5. The composition of claim 1 wherein the water is present in the composition in an amount of from 35% to 70% by weight, based on the weight of the composition.

6. The composition of claim 1 further containing an additive selected from the group consisting of organic solvents, anionic surfactants, nonionic surfactants, antistats, optical brighteners, resoiling inhibitors, preservatives, perfumes, and mixtures thereof.

7. The composition of claim 6 wherein the additive is a $C_{2-3}$ monoalcohol present in the composition in an amount of up to 20% by weight, based on the weight of the composition.

8. The composition of claim 6 wherein the additive is a surfactant selected from the group consisting of anionic surfactants, nonionic surfactants, and mixtures thereof, the surfactant being present in the composition in an amount of up to 5% by weight, based on the weight of the composition.

9. The composition of claim 1 wherein the composition has an apparent density of from 200 to 350 g/l.

* * * * *